United States Patent [19]

Galimberti

[11] Patent Number: 4,844,956

[45] Date of Patent: Jul. 4, 1989

[54] PRODUCT MADE UP OF A ROLL OF VALVED SYNTHETIC RESIN BAGS, WITH TRANSVERSAL WELDINGS AND PRE-ESTABLISHED SEPARATION LINES, FOR FILING THE BAGS BEFORE SEPARATION

[76] Inventor: Gianfranco Galimberti, Via Pancaldo No. 4, 20129 Milano, Italy

[21] Appl. No.: 119,184

[22] Filed: Nov. 10, 1987

[51] Int. Cl.[4] ..... B65D 30/00; B65D 30/24

[52] U.S. Cl. ..... 428/35.5; 383/37; 383/44; 383/47; 428/43; 428/906

[58] Field of Search ..... 383/37, 44, 47; 428/35, 428/43, 35.5, 906

[56] References Cited

U.S. PATENT DOCUMENTS

| | | | |
|---|---|---|---|
| 3,332,548 | 7/1967 | Piazze et al. | 383/37 |
| 3,384,294 | 5/1968 | Astle | 383/44 |
| 4,470,152 | 9/1984 | Blankenship | 383/37 |
| 4,566,131 | 1/1986 | Achelpohl | 383/44 |
| 4,672,688 | 6/1987 | Kalkipsakis | 383/44 |
| 4,681,785 | 7/1987 | Horn | 428/43 |
| 4,685,148 | 8/1987 | Titchenal | 383/37 |

*Primary Examiner*—Ellis P. Robinson
*Assistant Examiner*—James J. Seidleck
*Attorney, Agent, or Firm*—McGlew & Tuttle

[57] ABSTRACT

A product made up of a web that is a ribbon of valved bags of synthetic resin, with delimiting pairs of transversal weldings located in close proximity together and between which is formed a pre-established tear-off line permitting separation of the bags even after filling; the web or ribbon being manufactured as a roll, and the pairs of transversal weldings being adjacent to the valve of one of the contiguous bags and delimited by said weldings.

7 Claims, 3 Drawing Sheets

PRODUCT MADE UP OF A ROLL OF VALVED SYNTHETIC RESIN BAGS, WITH TRANSVERSAL WELDINGS AND PRE-ESTABLISHED SEPARATION LINES, FOR FILING THE BAGS BEFORE SEPARATION

FIELD AND BACKGROUND OF THE INVENTION

The invention refers to the production of valved synthetic resin bags, provided with profiles or shapings, cuts and laminar parts, internally or externally applied, or with foldings, to constitute retaining valves of the bag contents and to permit filling the bag with loose material. The production of this type of bag is known—according to a possible embodiment—by means of the application of welded thicknesses or linings forming a pocket; with an incision on the wall of the bag, the retaining and filling valve is thus completed.

SUMMARY AND OBJECTS OF THE INVENTION

The present invention relates to a packing comprising a plurality of valved bags—with external or internal applications or with foldings—which packing constitutes a product suitable for permitting mechanized filling in order to obtain a filling operation which is automized as much as possible.

With this in view, the invention provides a product comprising a web that is a ribbon of valved synthetic resin bags, with two transversal weldings, delimiting each single bag and located close together, and between which a pre—established tear-off line is formed, that permits the separation of the bags even after being filled; the tear-off line can be also carried out with a differentiated perforation step, corresponding to the bellow or gusset foldings, to take into account the greater thickness present thereon.

In practice, the pairs of transversal weldings are advantageously adjacent to the valve of one of the contiguous bags delimited by said weldings.

Each pre—established tear-off line can be a line of adjacent incisions, which permit tearing by means of devices already known.

The web or ribbon of bags can be manufactured as a roll, that is as a bobbin.

A product comprising a web or ribbon of bags, which maintains its continuity, permits an easy mechanization of the filling system with the feeding of the bag by means of the continuity of the product formed by the bags which are rolled up and, by their unwinding, are subsequenty presented to the filling means, which fills the bags one-by-one as they are presented; at least the last bag filled or being filled is maintained in a continuity condition with respect to the remaining product to be fed, which can keep suspended the bag being filled. The separation of the filled bags can be carried out at a station downstream from the filling device, immediately after filling, or even at a subsequent time or anyway at a distance from the filling device.

A valved bag for loose materials can have the filling valve formed by a suitable folding or a thickness, that is a lining, internally or externally welded in respect of the bag to form a pocket therein, and on the bottom of which pocket the wall of the bag is cut; the valve is oriented in such a way as to permit penetration of the filling nozzle in an orthogonal direction to the transversal weldings used for closing the bag.

The valve can be preferably located adjacent to one of the transversal weldings and with the mouth facing said welding, or parallel to the same welding.

According to a possible embodiment the valve is located with the mouth facing the welding and in a substantially central position with respect to the transversal dimension of the bag in the direction of weldings.

The valved bag can be of the type provided—at the corners—with diagonal weldings of the thicknesses forming the bellows.

BRIEF DESCRIPTION OF THE DRAWINGS

The drawing shows a possible embodiment and in particular.

DESCRIPTION OF THE PREFERRED EMBODIMENTS

Figure 1:
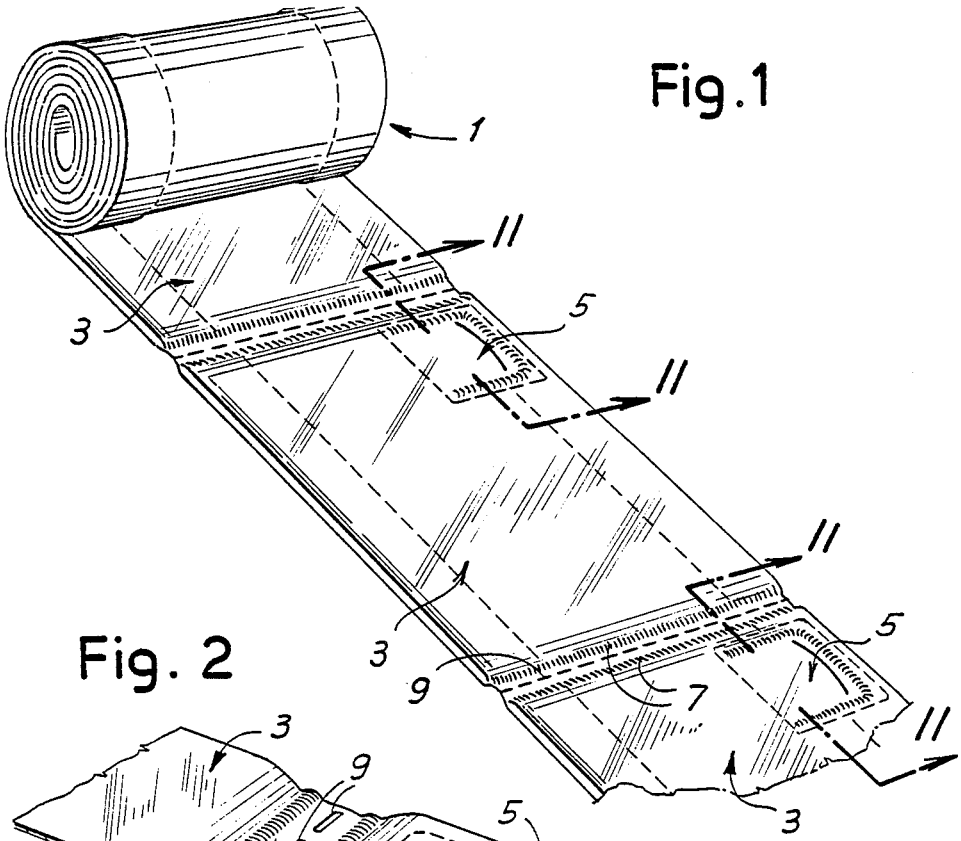
FIG. 1 shows a perspective view of a series of bags with a lateral valve, being unwound from a packed roll.
Figure 2:
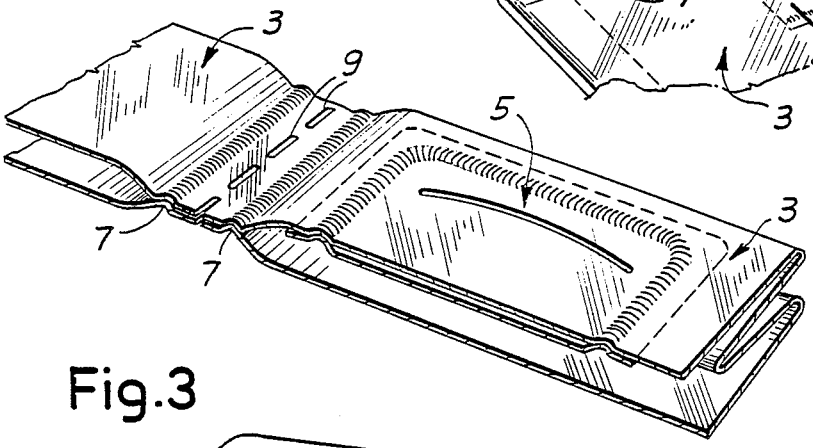
FIG. 2 shows a local section according to II—II of Fig.1.

According to what is shown in the drawing attached hereto, a product is made up of a roll 1 formed by a web or ribbon of successive bags 3 with a valve 5 to permit filling with loose materials; the various adjacent bags 3 are defined by pairs of transversal weldings 7 being close together and between which a tear-off line is located to separate the bags, as shown in the drawing by a series of incisions 9. The weldings 7 are close together and one of them is adjacent to a valve 5 of the relative bag, so that the filling of the bag is carried out adjacently to the relevant welding line 7. The bags can be unwound from the roll 1 and conveyed forward appropriately, using, if need be, suitable printed marks, or—respectively—suitable references represented by the incision line 9 and by the conformation of the bag adjacent to weldings 7, in order to position the bag in such a way as to be filled when the packing or assembly of bags has not yet been separated, thus permitting an automatized feeding of the bags to the filling system.

Figure 3:
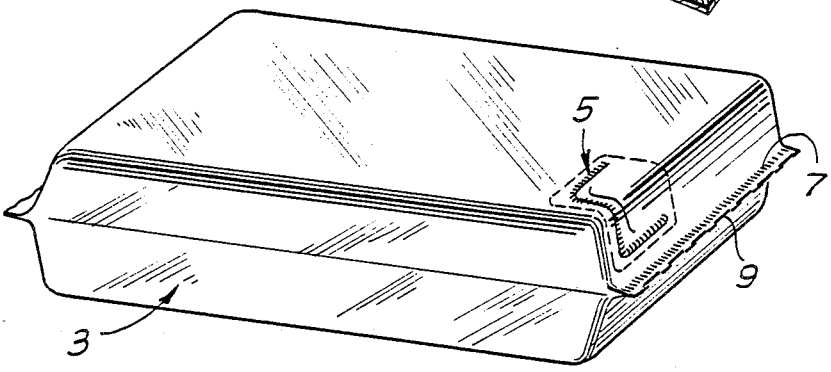
FIG. 3 shows a bag which has been filled and detached.
Figure 4:
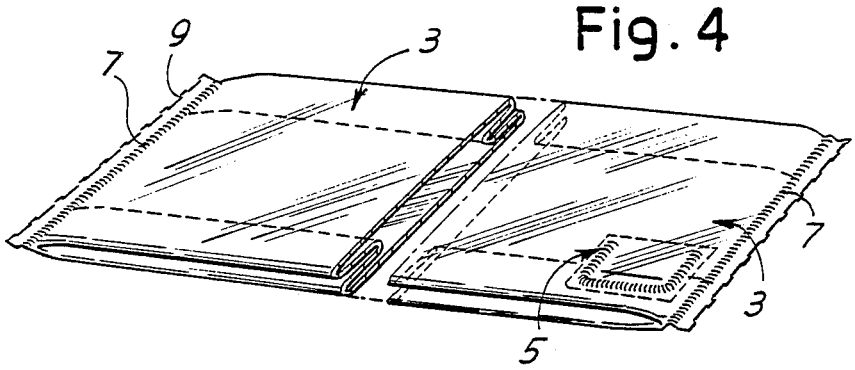
FIG. 4 shows a flattened bag of the bellow type.
Figure 5:
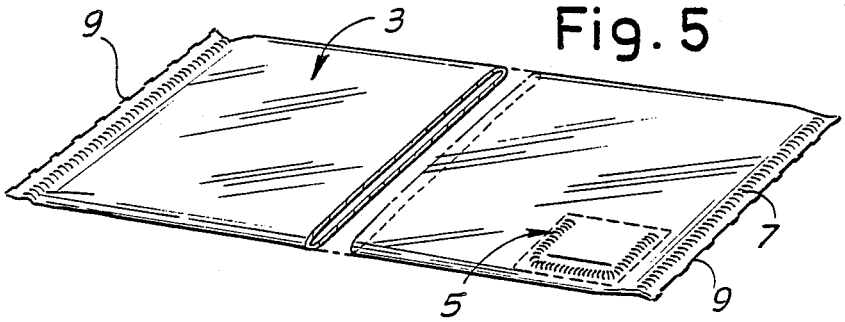
FIG. 5 shows, as in FIG. 4, a flattened bag of the non-bellow type.
Figure 6:
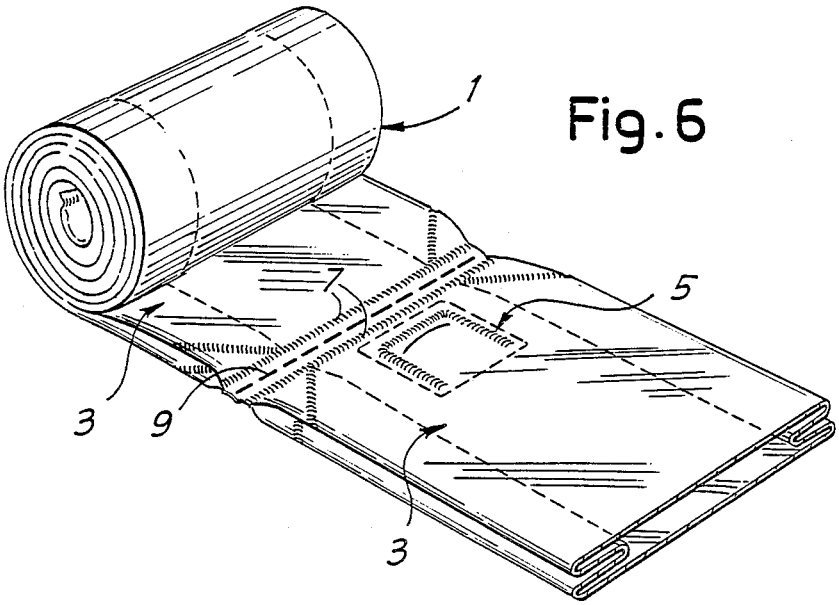
FIG. 6 shows, as in FIG. 1, an embodiment of a web or ribbon with bags having a valve longitudinally and preferably (but not compulsory) centrally located.

A filled bag is schematized in FIG. 3, from which the presence of valve 5 can be seen adjacent to the transversal welding line 7. In FIGS. 3 and 4, bag 3 illustrated is of the bellow type, whereas in FIG. 5 the bag is of the non-bellow type. FIGS. 1 to 5 contemplate a transversal input valve, mostly located laterally; FIG. 6 shows a web or ribbon of bags with a longitudinal input valve, mostly located centrally.

The bands or thicknesses forming the valves can be applied internally or externally to the bag.

It is evident that the packing of a rolled-up product such as 1, to form bags 3, is useful to mechanize and consequently to automatize the filling operation of the bags; this is particularly useful for reducing filling costs and increasing the speed of the filling operation itself, while also and above all reducing the tiresome labour of the operator in charge of this function.

The bag shown in FIGS. 6 to 10 is of the bellow type, that is provided, in addition to the two fronts 11 and 13, also with two longitudinal lateral folds 15, of the bellow type. The bag is delimited by weldings, lower 17 and upper 19, which affect the two thicknesses and the doubled thicknesses in correspondence to the bellows. In the illustrated embodiment, the bag is additionally provided with diagonal weldings 20 at the corners, which affect the thicknesses of the two corresponding bellow portions; these additional weldings 20 ensure a regular conformation of the filled bag, also excluding the penetration of loose material into the corner spaces S defined by the bellows.

The bag is manufactured with a valve of the type of those which contemplate the application of a flexible laminar thickness or lining—mostly of the same material as the bag—applied by welding along three sides in the form of a U, along the base of the U, a cut in the material of the bag being provided a constitute the valved access to the inside of the bag for filling; the band or lamina permits filling while preventing a spontaneous outflow of the loose material contained in the bag.

Figure 7:
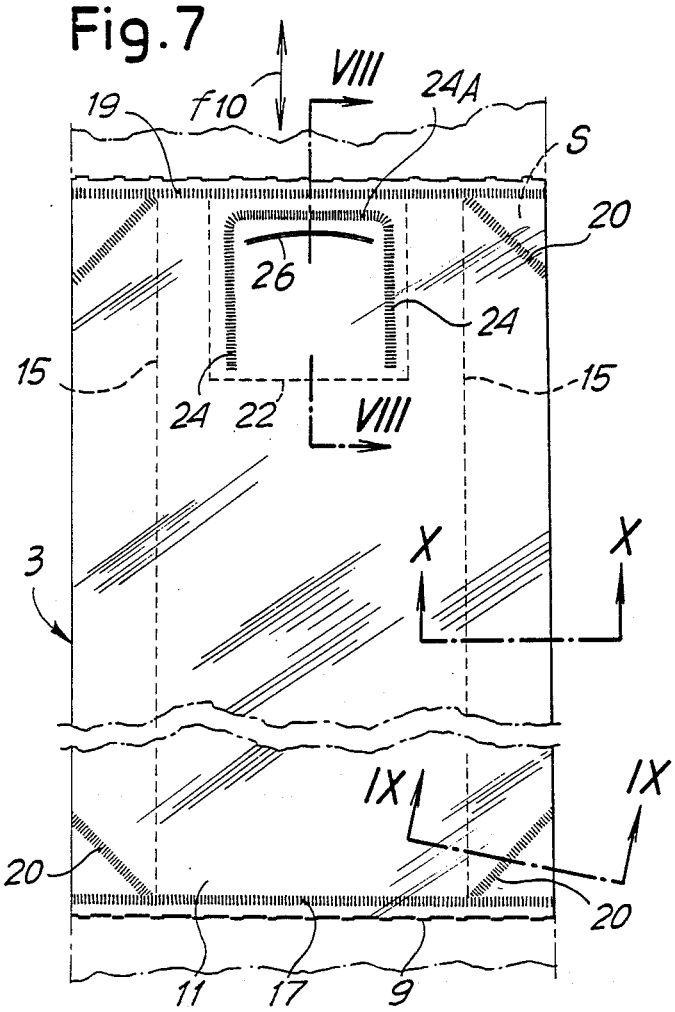
FIG. 7 shows a front view of a bag.
Figure 8:
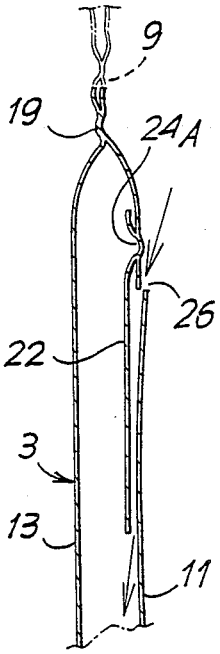
FIG. 8 shows a local section according to VIII—VIII of FIG. 7.
Figure 9:
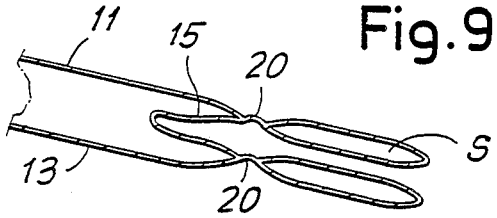
FIGS. 9 and 10 are local demonstrative sections according to IX—IX and X—X of FIG. 7, greatly enlarged.
Figure 10:
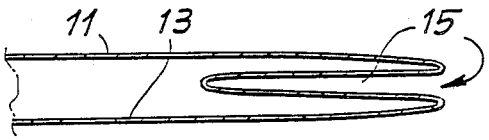

For a rational filling of the bag unrolled from roll 1, the valve on the bag is oriented in a longitudinal direction that is in order to permit filling and emptying according to the longitudinal direction indicated by the double arrow f10 in FIG. 7. In fact, according to what is illustrated, the valve comprises a patchlike laminar or band thickness 22 applied (according to the drawing inside the bag) to the wall of the bag by a U-welding indicated by 24 and 24A to form a pocket which is open in the stretch between the ends of the two branches 24 of the welding and at the bottom adjacent to the welding stretch 24A by means of a cut 26. This cut 26 can be rectilinear or shaped with a curvature in one way or the other, or even with a tongue shaping or profile.

Valve 22, 24, 24A and 26 is advantageously located extremely close to one of the transversal weldings, 19 in the drawing.

In any case the arrangement described permits filling the bag in a longitudinal direction, that is in a direction according to the double arrow f10 for the insertion and extraction of a filling and emptying implement and advantageously for filling and also emptying with the bag vertically placed or in a strongly inclined position with respect to the horizontal. The longitudinal orientation and the vicinity to a welding facilitates filling in the unwinding of the roll, and also the emptying.

I claim:

1. A roll of bags for loose material, the bags having a tubular wall made of synthetic resin and being releasably secured together in end-to-end relation in collapsed condition to form a ribbon extending axially of the tubular wall, pairs of adjacent welds extending transversely across the ribbon with the welds of each pair defining opposite ends of adjacent bags, a line of separation provided between the adjacent welds of each pair along which each bag can be separated from the ribbon and a filling valve adjacent one weld of each pair, each valve comprises a patch secured to the wall by a pair of elongate patch weld portions located spaced apart, in opposed relation, adjacent a top end of each bag and extending away from the bag perimeter, and an elongate severance is formed in the wall to extend transversely between longitudinal ends of the path weld portions adjacent the bag perimeter to define a mouth of the valve.

2. A roll of bags according to claim 1, wherein each bag is elongate in the longitudinal direction of the ribbon, the transverse welds of each pair defining a top end and a bottom end of successive, adjacent bags.

3. A roll of bags according to claim 1, wherein the patch weld portions extend transversely away from the transverse welds and the severance extends adjacent the transverse weld.

4. A roll of bags according to claim 1, wherein a third patch weld portion bridges adjacent longitudinal ends of the pair of patch weld portions to form therewith a composite U-shaped patch weld and the severance is formed adjacent the third patch weld portion.

5. A roll of bags according to claim 1 wherein bellow-form folds extend along respective oposite sides of each bag longitudinally of the ribbon.

6. A roll of bags according to claim 5 wherein welds extend diagonally across the bellow-form folds between the weld of each pair of transversed welds and a longitudinal edge of the ribbon, defining corners of each bag.

7. A roll of bags for loose material, the bags having a tubular wall made of synthetic resin and being releasably secured together in end-to-end relation to form, in collapsed condition, a ribbon extending axially of the tubular wall, pairs of adjacent welds extending transversely across the ribbon with the welds of each pair defining top and bottom ends of adjacent bags, a line of separation provided between the adjacent welds of each pair along which each bag can be separated from the ribbon, each bag being elongate in the longitudinal direction of the ribbon, a filling valve comprising a patch secured to the tube wall by a U-shaped weld adjacent a top end of each bag, the base of the weid being adjacent one of the top and a longitudinal edge of the bag, a severance providing a valve mouth being formed adjacent the base of the patch weld, and bellows-form folds extending along respective opposite longitudinal edges of each bag wall defining opposite side portions of each bag of equal thickness.

* * * * *